US011700893B2

(12) United States Patent
Mallady, Jr.

(10) Patent No.: US 11,700,893 B2
(45) Date of Patent: Jul. 18, 2023

(54) PROTECTIVE FACE MASK

(71) Applicant: Roy C. Mallady, Jr., Atlanta, GA (US)

(72) Inventor: Roy C. Mallady, Jr., Atlanta, GA (US)

( * ) Notice: Subject to any disclaimer, the term of this patent is extended or adjusted under 35 U.S.C. 154(b) by 0 days.

(21) Appl. No.: 17/954,526

(22) Filed: Sep. 28, 2022

(65) Prior Publication Data

US 2023/0018659 A1 Jan. 19, 2023

Related U.S. Application Data

(62) Division of application No. 16/869,910, filed on May 8, 2020, now Pat. No. 11,617,402.

(60) Provisional application No. 63/014,492, filed on Apr. 23, 2020.

(51) Int. Cl.
*A41D 13/11* (2006.01)

(52) U.S. Cl.
CPC ..... *A41D 13/1161* (2013.01)

(58) Field of Classification Search
CPC . A41D 13/11; A41D 13/1107; A41D 13/1115; A41D 13/1161; A61F 9/04; A61F 9/045; A42B 1/046
USPC ..... 128/206.19, 857
See application file for complete search history.

(56) References Cited

U.S. PATENT DOCUMENTS 825,170 A * 7/1906 Allen ..... A41D 13/11 2/206
1,331,701 A * 2/1920 Fendelman ..... A42B 1/0182 2/10
1,994,212 A * 3/1935 Davis ..... A42B 1/046 2/205
2,023,267 A 12/1935 Saint et al.
3,768,100 A * 10/1973 Colman ..... A41D 13/1161 2/9
4,845,779 A * 7/1989 Wheeler ..... A42B 1/046 2/84
4,961,232 A * 10/1990 Hulsey ..... A41D 13/1146 2/205
4,969,473 A * 11/1990 Bothwell ..... A41D 13/1153 433/136
6,098,201 A * 8/2000 Boros, Sr. ..... A41D 13/1146 2/9
6,269,489 B1 * 8/2001 Heath ..... A42B 1/046 2/202
6,526,585 B1 * 3/2003 Hill ..... A41D 13/1184 2/206
6,843,248 B2 1/2005 Japuntich et al.
7,044,127 B1 * 5/2006 Fernandez DeCastro ..... A41D 13/11 128/205.27

(Continued)

FOREIGN PATENT DOCUMENTS

CN 204120286 U * 1/2015 ..... A41D 13/1115
GB 190609962 3/1907

(Continued)

*Primary Examiner* — Heather Mangine
(74) *Attorney, Agent, or Firm* — David L. King

(57) ABSTRACT

A protective face mask has a first panel, a second panel and a plurality of head attachment features. The first panel is configured to cover the facial area of a wearer below the eyes with a mouth opening for the mouth region of the wearer to allow the wearer to eat, drink or smoke. The second panel is configured to cover the mouth opening when not used for passing food, drink or smoking. The plurality of head attachment features are located at outer edges of the face mask panels.

3 Claims, 8 Drawing Sheets

(56) References Cited

U.S. PATENT DOCUMENTS

D642,259 S * 7/2011 Messier ..... D24/110.1
8,757,156 B2 6/2014 Martin et al.
D767,115 S * 9/2016 Mingo ..... D24/110.1
D803,391 S * 11/2017 Reese ..... D24/110.1
D828,544 S * 9/2018 Lee ..... D24/110.1
10,912,959 B1 * 2/2021 Showalter ..... A62B 18/086
10,980,296 B1 * 4/2021 Hosac ..... A62B 18/10
11,000,624 B1 * 5/2021 Babcock ..... A61L 9/20
11,064,744 B1 * 7/2021 Palacios ..... A41D 13/1107
11,083,231 B1 * 8/2021 Lewis ..... A41D 13/1176
11,134,729 B1 * 10/2021 Schwartz ..... A62B 18/00
D936,207 S * 11/2021 Mallady, Jr. ..... D24/110.1
D937,405 S * 11/2021 Mallady, Jr. ..... D24/110.1
D939,689 S * 12/2021 Mallady, Jr. ..... D24/110.1
11,202,925 B1 * 12/2021 Awad ..... A62B 7/10
11,207,490 B1 * 12/2021 Fried ..... A61M 21/02
D947,363 S * 3/2022 Eldibany ..... D29/108
D947,364 S * 3/2022 Eldibany ..... D24/110.4
D947,365 S * 3/2022 Eldibany ..... D29/108
D964,548 S * 9/2022 Rookard ..... D29/108
11,484,072 B1 * 11/2022 Kim ..... A41D 13/11
D973,968 S * 12/2022 Yoo ..... D29/108
2003/0024533 A1 2/2003 Sniadach
2007/0023046 A1 * 2/2007 Huang ..... A62B 18/025 128/206.12
2009/0071483 A1 * 3/2009 Son ..... A62B 18/025 128/206.13
2014/0076334 A1 * 3/2014 Cheng ..... A61B 46/00 128/857
2014/0202469 A1 * 7/2014 Smaller ..... A62B 18/025 128/863
2014/0237695 A1 * 8/2014 Al Malki ..... A41D 13/1192 2/9
2014/0251335 A1 * 9/2014 Black ..... A61M 16/0616 128/206.25
2015/0113711 A1 * 4/2015 Kim ..... A42B 1/205 2/424
2015/0173436 A1 * 6/2015 Tsuei ..... A41D 13/113 2/424
2016/0029716 A1 * 2/2016 Duncan ..... A41D 13/11 128/863
2016/0316831 A1 * 11/2016 Yarahmadi ..... A41D 23/00
2016/0332008 A1 * 11/2016 McAndrews ..... A62B 18/025
2017/0105868 A1 * 4/2017 Smith ..... A61F 6/04
2017/0209720 A1 * 7/2017 Mingo ..... A62B 23/025
2017/0312558 A1 * 11/2017 Wang ..... A62B 23/025
2018/0007982 A1 * 1/2018 Reese ..... A41H 42/00
2020/0008970 A1 * 1/2020 Parker ..... A41D 31/00
2020/0329792 A1 * 10/2020 Howard ..... A41D 13/11
2020/0404991 A1 * 12/2020 Karakostas ..... A41D 13/1161
2021/0228403 A1 * 7/2021 Waring ..... A61B 5/087
2021/0283433 A1 * 9/2021 Yeh ..... A62B 18/086
2021/0322797 A1 * 10/2021 Hussain ..... A41D 13/1107
2021/0329993 A1 * 10/2021 Mallady, Jr. ..... A41D 13/1161
2021/0337889 A1 * 11/2021 Silverberg ..... A41D 13/0053
2021/0346118 A1 * 11/2021 Kacker ..... A41D 13/11
2021/0346668 A1 * 11/2021 Woodson ..... A61M 39/04
2021/0346736 A1 * 11/2021 Ravikumar ..... A41D 13/1107
2021/0368874 A1 * 12/2021 Eldibany ..... A41D 13/1161
2021/0392965 A1 * 12/2021 Johnson ..... A41D 13/113
2021/0392966 A1 * 12/2021 Nguyen ..... A41B 3/00
2022/0016452 A1 * 1/2022 Weiss ..... A41D 13/11
2022/0022571 A1 * 1/2022 Araujo ..... A41D 13/1107
2022/0030968 A1 * 2/2022 Nasrallah ..... A41D 27/24
2022/0047010 A1 * 2/2022 Parker ..... A41D 13/1161
2022/0053849 A1 * 2/2022 Morton ..... A41D 13/1107
2022/0062671 A1 * 3/2022 Kanyikirize ..... A41D 13/1107
2022/0071322 A1 * 3/2022 Stenson ..... A41D 13/1161
2022/0095718 A1 * 3/2022 Floyd ..... A41D 13/1161
2022/0134143 A1 * 5/2022 James ..... B01D 39/18 128/206.19
2022/0175066 A1 * 6/2022 Lewis ..... A41D 13/1176
2022/0176170 A1 * 6/2022 Daniels ..... A41D 13/1107
2022/0225700 A1 * 7/2022 Samuel ..... A41D 13/11
2022/0362589 A1 * 11/2022 McMillan-Siah .... A62B 18/086
2022/0378125 A1 * 12/2022 Mallady, Jr. ..... A41D 13/1107
2023/0054229 A1 * 2/2023 Barker ..... A41D 13/1192

FOREIGN PATENT DOCUMENTS

KR 100702892 B1 * 4/2007 ..... A41D 13/1115
KR 20110003053 3/2011
KR 20110006846 U * 7/2011
KR 20120100611 A * 9/2012
KR 101326975 B1 * 11/2013
KR 20180000919 U * 4/2018
KR 20190140876 A * 12/2019

* cited by examiner

PROTECTIVE FACE MASK

RELATED APPLICATIONS

The present invention is a division of co-pending U.S. application Ser. No. 16/869,910 filed on May 8, 2020 entitled "Protective Face Mask".

TECHNICAL FIELD

The present invention relates to a protective face mask, more particularly, to a face mask that allows the wearer to eat, drink or smoke without completely removing the face mask.

BACKGROUND OF THE INVENTION

Face masks have been used in an effort to filter air for a variety of purposes.

Protective face masks are generally used for preventing the transmission of contagious diseases, as well as to protect from inhalation of industrial or city dust or dirt, chemicals, allergens, and the like that may be present in the atmosphere; medical masks have been used in hospital type environments to protect the user against inhaling undesirable viruses or micro-organisms. These masks are used to maintain a private, enclosed space around the breathing orifices when a person is in close proximity to other persons, or if an undesirable atmospheric agent is present. Additionally, infectious persons can wear masks to protect other people in the vicinity from their pathogens.

A variety of masks have been developed with different features, such as different ways of retaining the mask in place, providing comfort for the wearer, having valves for inhaling or exhausting, having seals around the mask for tighter sealing of the mask to the wearer's face, etc.

Removing the mask means that the respiratory system is no longer protected, however, when the wearer wishes to eat or drink, conventional masks must be removed so that food or drink can be imbibed risking exposure to these atmospheric agents.

The present invention as disclosed herein solves these limitations by providing a structural advantage not found in existing designs.

SUMMARY OF THE INVENTION

A protective face mask has a first panel, a second panel and a plurality of head attachment features. The first panel is configured to cover the facial area of a wearer below the eyes with a mouth opening for the mouth region of the wearer to allow the wearer to eat, drink or smoke. The second panel is configured to cover the mouth opening when not used for passing food, drink or smoking. The plurality of head attachment features are located at outer edges of the face mask panels.

The second panel can be attached to the first panel with hook and loop fastener means. This allows covering or uncovering of the mouth opening by attaching or detaching the hook and loop fasteners and folding or unfolding the second panel.

An alternative face mask has the second panel attached at one side near the mouth opening and covers the first panel completely when the head attachment features on an opposite side are secured to the wearer.

Another alternative face mask has the second panel attached at one side of the first panel and covers the first panel completely when the head attachment features on an opposite side are secured to the wearer.

BRIEF DESCRIPTION OF THE DRAWINGS

The invention will be described by way of example and with reference to the accompanying drawings in which.

DETAILED DESCRIPTION OF THE INVENTION

Figure 1:
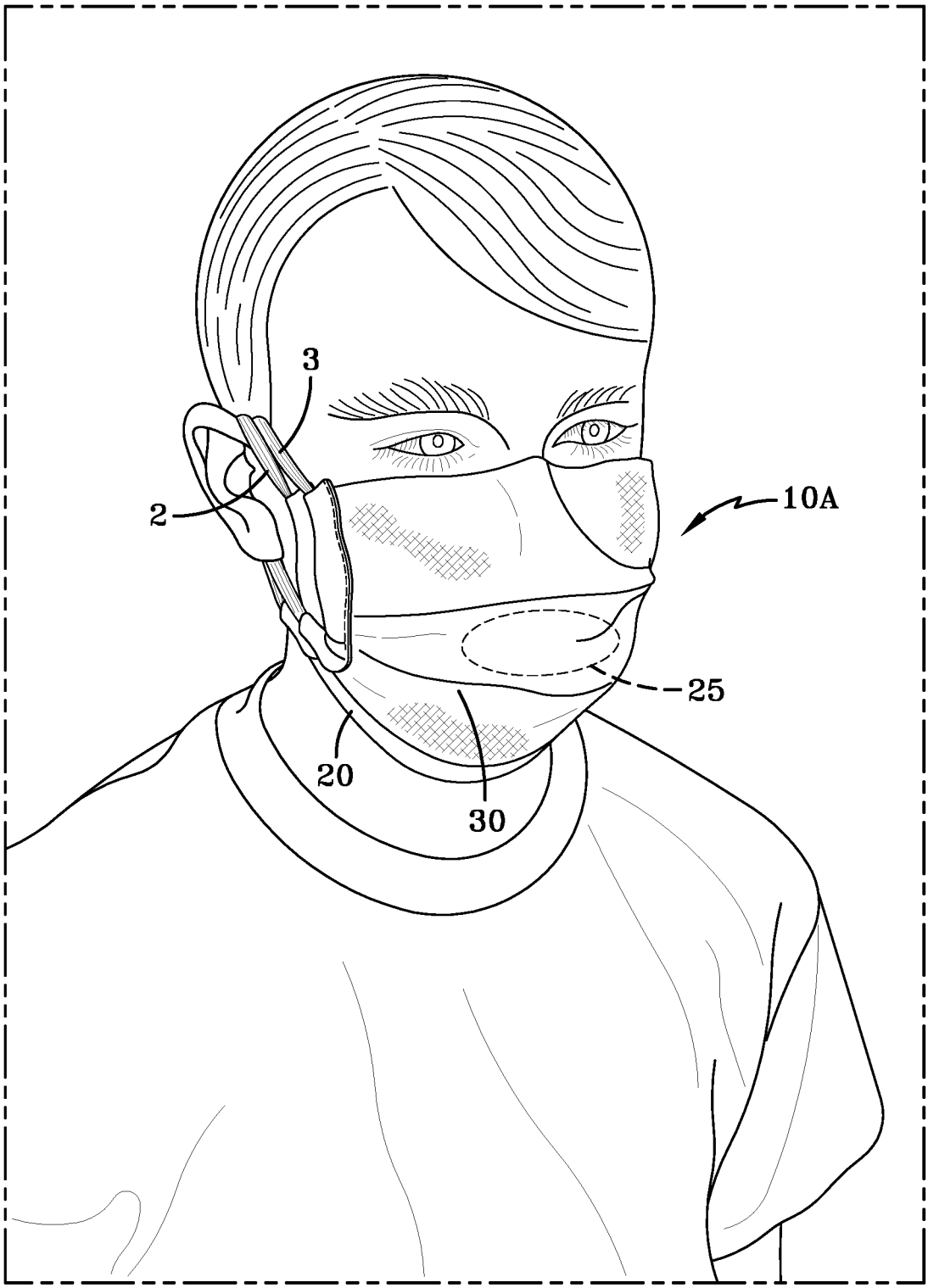
FIG. 1 is an environmental view of the protective face mask of the present invention.

With reference to FIG. 1, the present invention protective face mask is shown on an exemplary wearer in a covered or closed position. The dashed lines showing the mouth opening 25 fully covered by a second panel 30.

Figure 2:
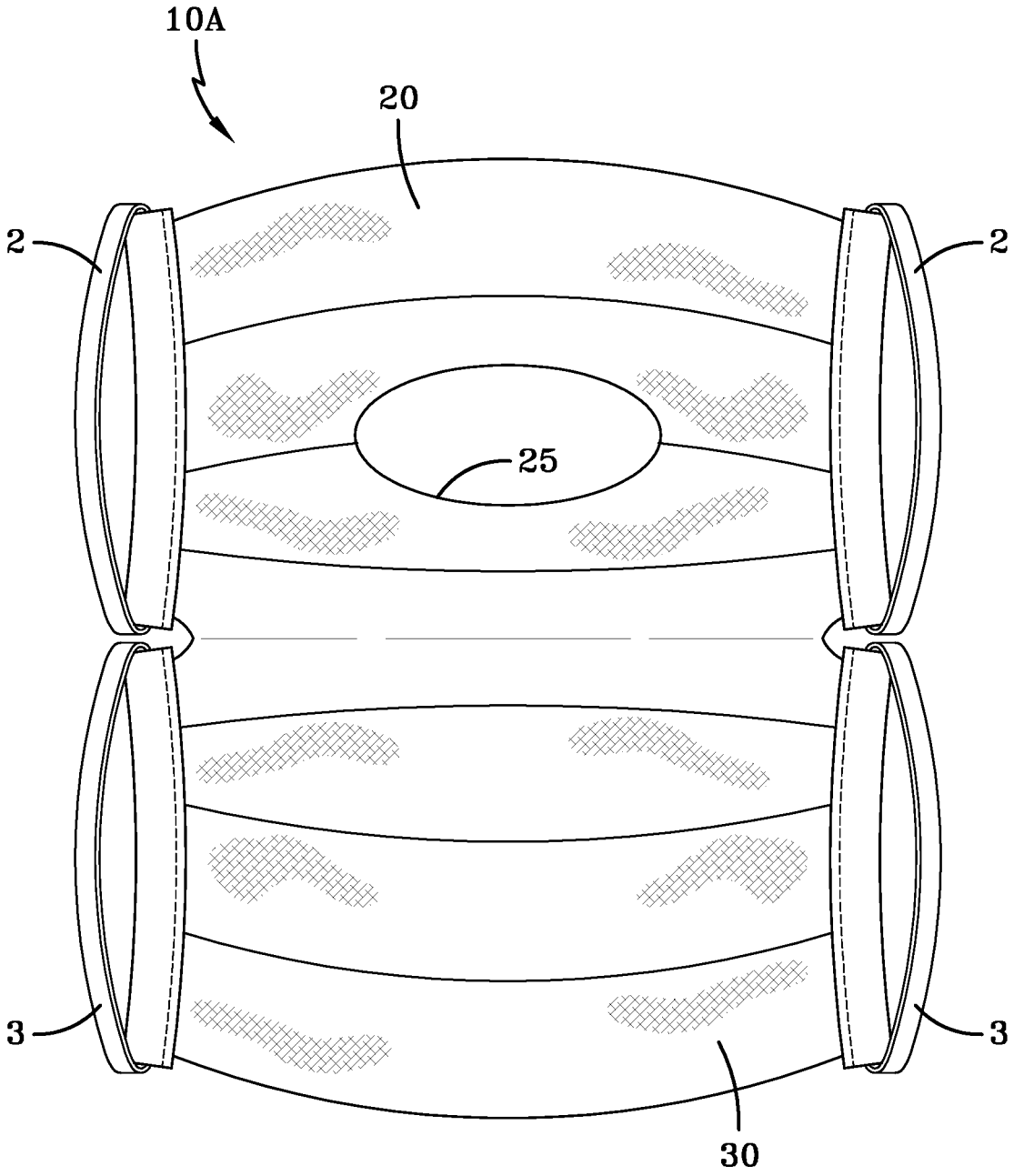
FIG. 2 is a perspective view of a first embodiment protective face mask of the present invention in an open position.
Figure 2B:
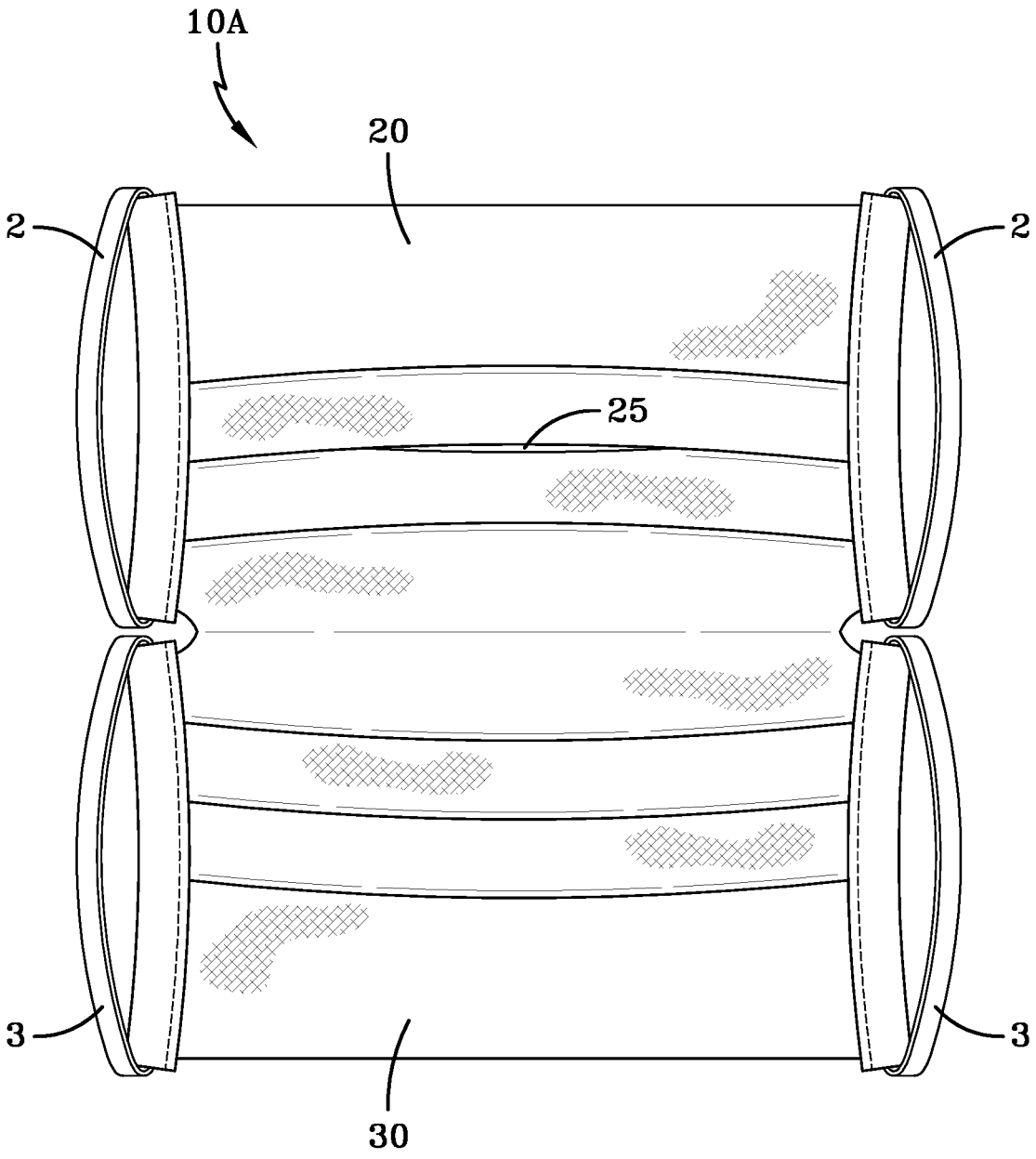
FIG. 2B is a perspective view of a first embodiment protective face mask with a smaller mouth opening in an open position.

With reference to FIG. 2, a protective face mask 10A is shown in a first embodiment that has a first panel 20 with a mouth opening 25 in the general location of the wearer's mouth and a second panel 30 with no openings. The face mask 10A is held on the wearer's head with attachment loops 2 on the first panel 20 and attachment loops 3 on the second panel 30. When the second panel 30 is in an uncovered position, the attachment loops 3 are removed from the wearer and the second panel 30 is folded down or away from the first panel 20 and the mouth opening 25 is fully exposed. When the second panel 30 is folded or lifted up overlaying the first panel 20 in a covered position with attachment loops 3 secured to the wearer, the opening 25 is completely covered. The first and second panels 20, 30 can be formed and folded over made from a single panel of material or fabric. FIG. 2B shows a variation of the first embodiment mask 10A with a smaller or slit opening 25.

Figure 3:
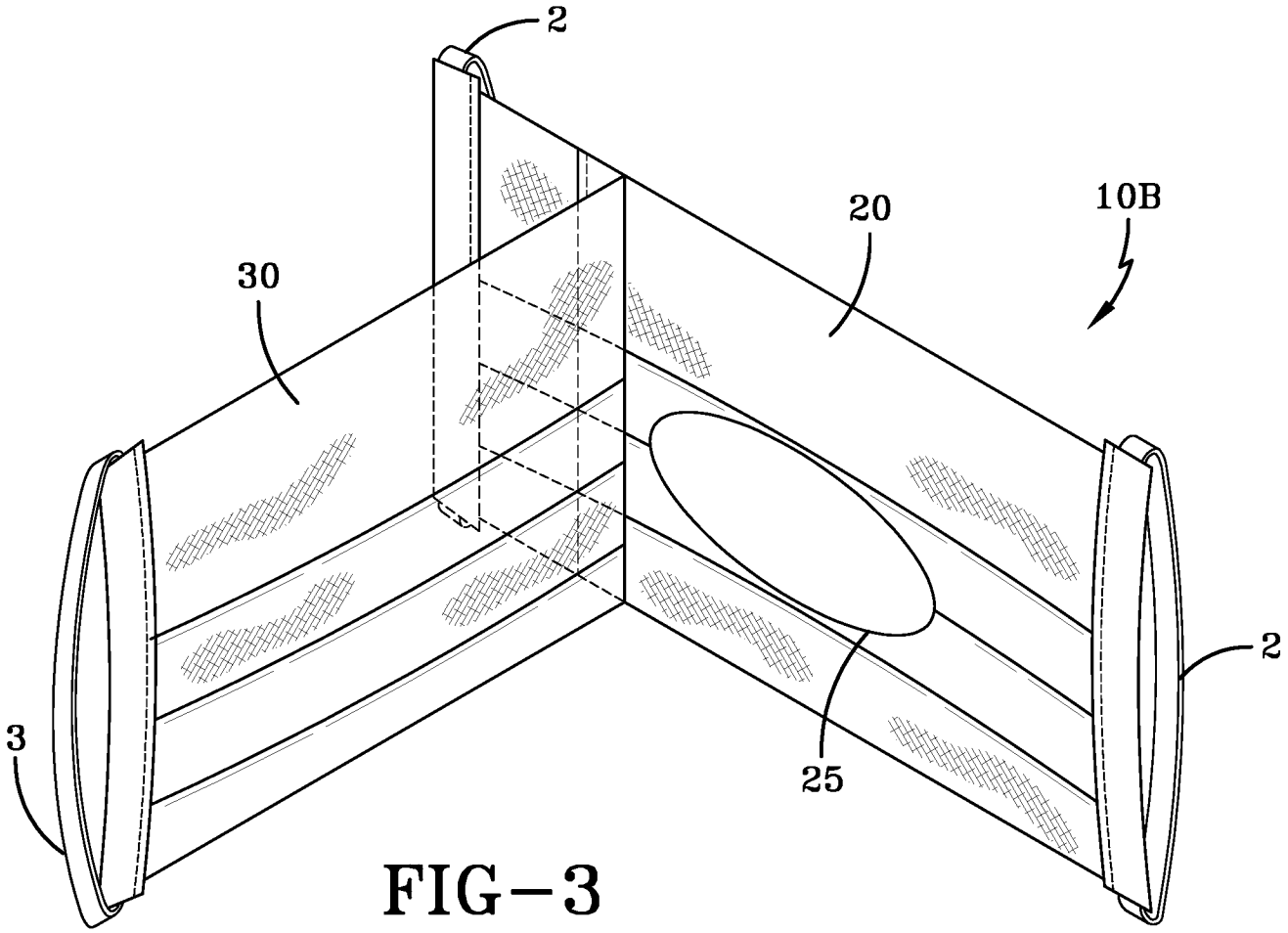
FIG. 3 is a perspective view of the second embodiment protective face mask in a partially open position.
Figure 3B:
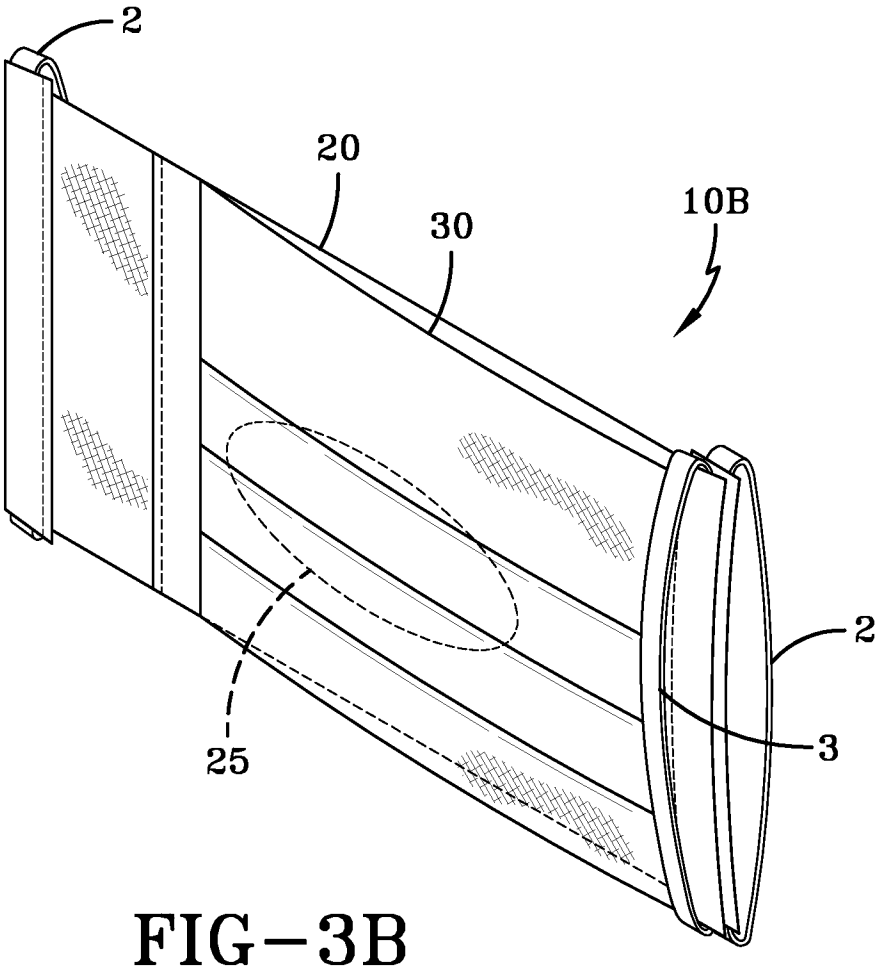
FIG. 3B is a perspective view of the second embodiment protective face mask of the present invention in the covered or closed position.

With reference to FIG. 3, a second embodiment face mask 10B is illustrated with similar attachment features to the first embodiment. In this embodiment face mask 10B, the second panel 30 is attached to the first panel 20 near the location of the opening 25 and only has one attachment loop 3 on an opposite side for being held in place on the wearer's head. The uncovered position is achieved by removing the head attachment loop 3 of the second panel 30 and folding the second panel 30 away from the opening 25 and securing the attachment loop 3 to the opposite side of the wearer's head. Again, the first panel 20 and second panel 30 can be made from a single piece of material and folded over. FIG. 3B is a view taken from FIG. 3 showing the mask 10B in the covered or closed position.

Figure 4:
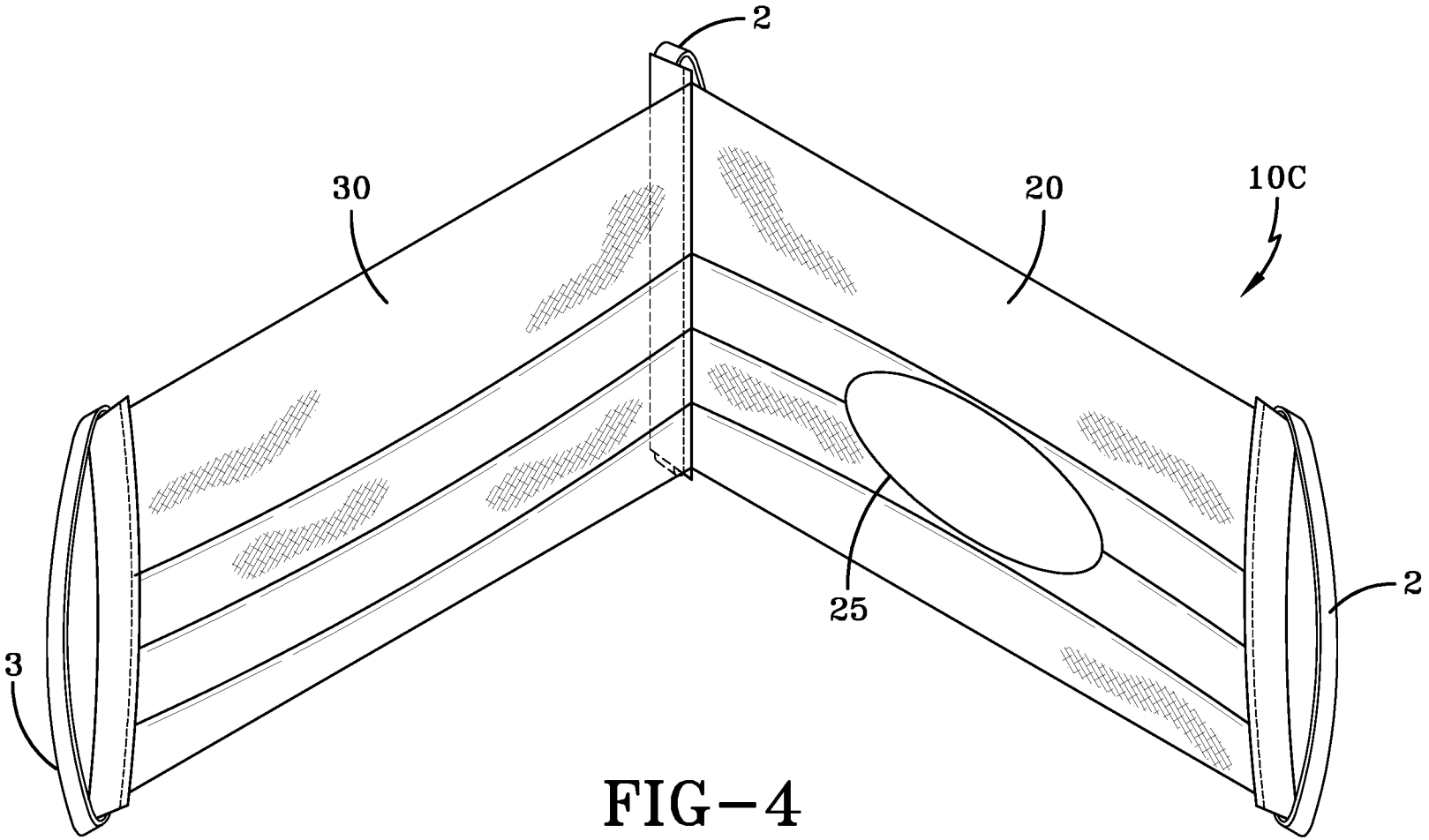
FIG. 4 is a perspective view of a third embodiment protective face mask of the present invention in a partially open position.
Figure 4B:
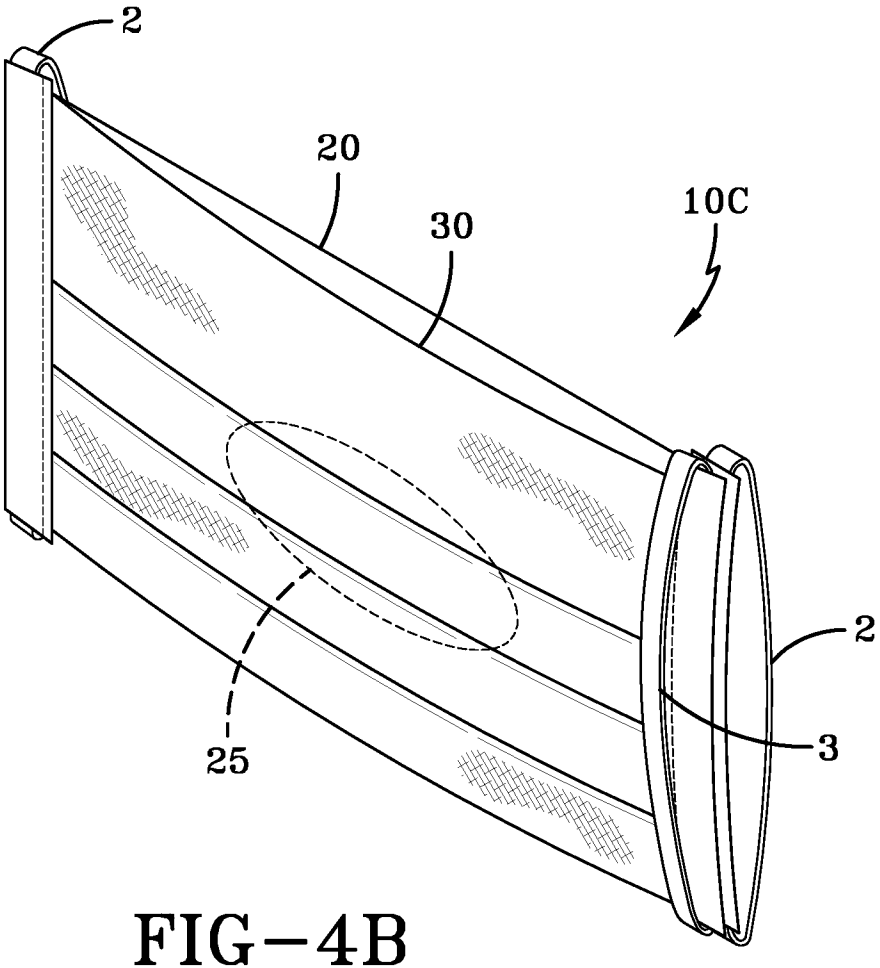
FIG. 4B is a perspective view of a third embodiment protective face mask of the present invention in the covered or closed position.

With reference to FIG. 4 a third embodiment face mask 10C is illustrated. In this embodiment, the second panel 30 is attached to the first panel 20 near the location of the attachment loop 2 of the first panel 20 on one side of the wearer's head and extends across the first panel 20 and secures to the wearer's head with attachment loop 3 at an opposite side when in the covered position. The uncovered position is achieved by removing the head attachment loop 3 on the second panel 30 and folding the second panel 30 away from the opening 25 and securing the attachment loop 3 to the opposite side of the wearer's head. FIG. 4B shows the mask 10C in the covered or closed position.

Figure 5:
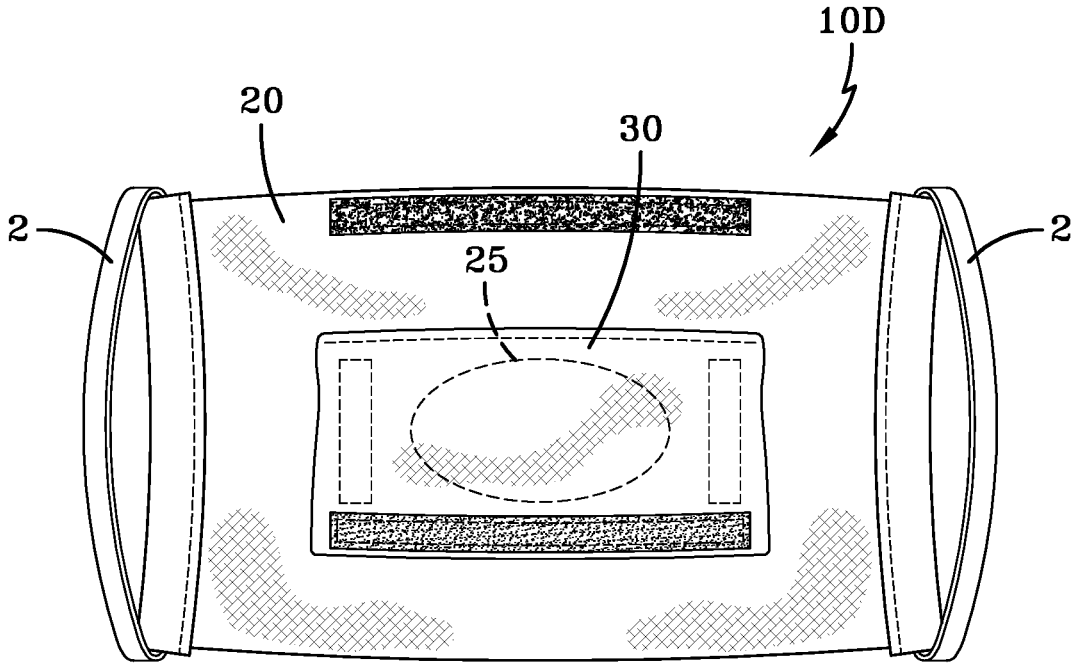
FIG. 5 is a perspective view of an alternative fourth embodiment protective face mask of the present invention in a covered or closed position.
Figure 6:
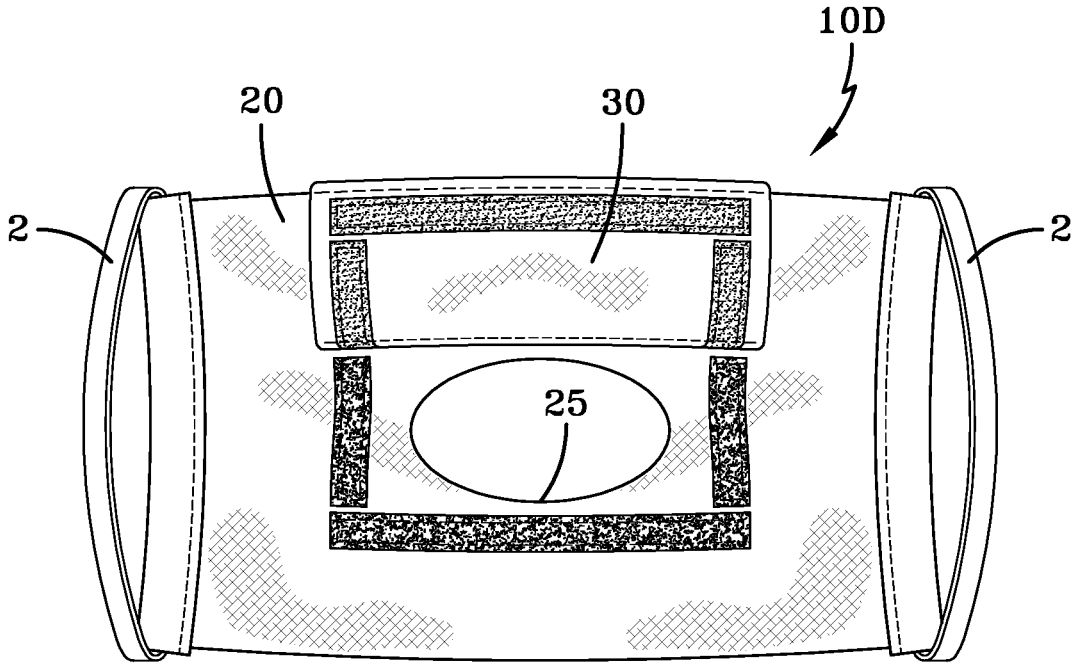
FIG. 6 is a perspective view taken from FIG. 5 with the mouth opening uncovered in an open position.

As shown in FIGS. 5 and 6, a fourth embodiment protective face mask 10D has the second panel 30 attached to the first panel 20 by a hook and loop fastener 7 means eliminating the head attachment feature(s) of the second panel 30. The second panel 30 can be partially detached from the first panel 20 and folded up or down, depending on the orientation of the mask 10D, uncovering the opening 25 allowing the wearer to eat, drink or smoke, as shown in FIG. 6.

In these protective face mask embodiments 10A-D, the second panel 30 can be raised or folded away from the opening 25 in the first panel 20 when the wearer chooses to eat, drink or smoke. As shown in the figures, the outer perimeter or edge of the mouth opening 25 is completely enclosed or bounded or encircled by the first panel 20.

The protective face mask 10A, 10B, 10C, 10D may be held in place on the wearer's face by a variety of means, including loops 2, 3 over the ears, elastic bands 4 extending around the back of the wearer's head, or tie straps 5 that either extend around the wearer's ears or around the back of the wearer's head.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims. The surgical access window described herein encompasses the dimensions presented and any and all variations applicable to the methods and surgical technique described directly or indirectly intended with this device.

What is claimed is:

1. A protective face mask comprising:

a continuous piece of fabric material having a first panel portion and a second panel portion;

the first panel portion configured to cover a facial area below eyes of a wearer, and having a mouth opening for a mouth region to allow the wearer to eat, drink or smoke;

the continuous piece of fabric material folded upward to create a bottom edge of the face mask such that the second panel portion at least partially overlays the first panel portion in a covered position for covering the mouth opening when not passing food, drinking or smoking, the second panel portion being integral to the first panel portion at the bottom edge; and a plurality of head attachment features, wherein a first one of the plurality of head attachment features is at a first outer side edge of the first panel portion and a second one of the plurality of head attachment features is at a second outer side edge of the first panel portion and wherein a third one of the plurality of head attachment features is at a first outer side edge of the second panel portion and a fourth one of the plurality of head attachment features is at a second outer side edge of the second panel portion.

2. The protective face mask of claim 1, wherein the second panel is integral to the first panel at the bottom edge and folded up or down to cover or uncover the mouth opening.

3. The protective face mask of claim 1, wherein the mouth opening is completely enclosed or bounded by the first panel.

* * * * *